United States Patent [19]

Hughes

[11] 4,418,488

[45] Dec. 6, 1983

[54] PISTOL AND REMOVABLE CARTRIDGE SHAPED BARREL INSERT

[76] Inventor: Jack Hughes, P.O. Box 275 Thrall Rd., Ellensburg, Wash. 98926

[21] Appl. No.: 307,741

[22] Filed: Oct. 2, 1981

[51] Int. Cl.[3] ..... F41C 3/00; F41C 21/10; F41C 21/22

[52] U.S. Cl. ..... 42/75 B; 42/77; 102/446

[58] Field of Search ..... 42/10, 77, 1 G, 75 B, 42/1 L, 1 S; 102/446

[56] References Cited

U.S. PATENT DOCUMENTS

| | | | |
|---|---|---|---|
| 2,149,707 | 3/1939 | Murbach | 42/75 B |
| 3,050,894 | 8/1962 | Ivy . | |
| 3,352,046 | 11/1967 | Warner et al. | 42/1 G |
| 3,453,763 | 7/1969 | Barr et al. | 42/1 L |
| 3,598,053 | 8/1971 | Glater | 42/77 |
| 3,729,853 | 5/1973 | Critcher | 42/1 L |
| 4,173,169 | 11/1979 | Yates et al. | 42/1 S |

*Primary Examiner*—Charles T. Jordan
*Assistant Examiner*—Ted L. Parr
*Attorney, Agent, or Firm*—Wells, St. John & Roberts

[57] ABSTRACT

A pistol and cartridge shaped barrel insert is described that makes use of a unique center-fire cartridge shaped barrel insert that can be used as the barrel of a pistol and as a rimfire cartridge insert for a large bore weapon. The pistol body includes a frame with an extensible nose piece that allows insertion and removal of the cartridge insert. The cartridge insert includes an internal secondary firing pin that can be actuated to fire a rimfire cartridge by a hammer on the pistol frame or by the usual hammer and center fire mechanism of a large bore weapon. A resilient pad within the insert yieldably urges the secondary firing pin away from the breech end of the barrel.

11 Claims, 7 Drawing Figures

PISTOL AND REMOVABLE CARTRIDGE SHAPED BARREL INSERT

TECHNICAL FIELD

The present invention relates to firearms and more particularly to pistols and "subcaliber" cartridge firing inserts for large bore, center-fire weapons.

BACKGROUND OF THE INVENTION

A need exists, with increased interest in backpacking, fishing and hunting, for a compact, versatile, safe and reasonably priced pistol for rimfire cartridges. There is also a need for an effective adaptor or insert for large bore center fire weapons that will allow rimfire cartridges to be fired from the larger bore weapons. An ideal solution to these related problems is found in the present invention.

A pistol and a small bore insert for large bore weapons may both be provided through the present invention.

The pistol configuration is adapted to use the small bore insert as a barrel. The insert can be selectively removed from the pistol body and loaded into the firing chamber of a larger bore weapon, thereby enabling the large bore weapon to fire a small bore cartridge.

Inserts or adaptors have been developed that allow firing of small bore, "rimfire" cartridges from larger bore "center- fire" weapons. They are generally made of soft metal (such as aluminum) since the expansive forces of cartridges fired within the insert are accommodated by the firing chamber of the larger bore weapon. Without the strength of the heavy, large bore firing chamber, the small bore inserts would at best have a rather short life and conceivably could explode.

Prior forms of inserts are also unsafe to carry in a "loaded" condition with the small bore cartridge in place. Prior inserts typically include their own firing pin that may be struck by a center fire firing pin and, in turn, strikes the "rim" of the small bore cartridge. The insert firing pin is typically mounted with its rimfire end in direct abutment with the small bore cartridge rim. It takes much less striking force to fire a rimfire cartridge than it does a larger bore center-fire cartridge. Therefore, there is always potential danger that a loaded insert could fire if dropped or otherwise handled carelessly. Other inserts that allow for axial travel of the insert firing pin are just as dangerous because there is no provision to yieldably hold the firing pin back away from the small bore cartridge rim.

U.S. Pat. No. 3,050,894 illustrates in FIGS. 13 through 16, a barrel insert that allows a center fire weapon to fire a rim fire cartridge. The insert includes a firing pin mechanism that slides freely in the cartridge to engage the rim of a rim fire cartridge. Another U.S. Pat. No. 3,598,053 shows a similar arrangement, only with the rim fire end of the firing pin having two pin branches, both for striking a rim fire cartridge.

BRIEF DESCRIPTION OF THE DRAWINGS

The present invention is illustrated in the accompanying drawings in which.

DETAILED DESCRIPTION OF A PREFERRED EMBODIMENT

Figure 1:
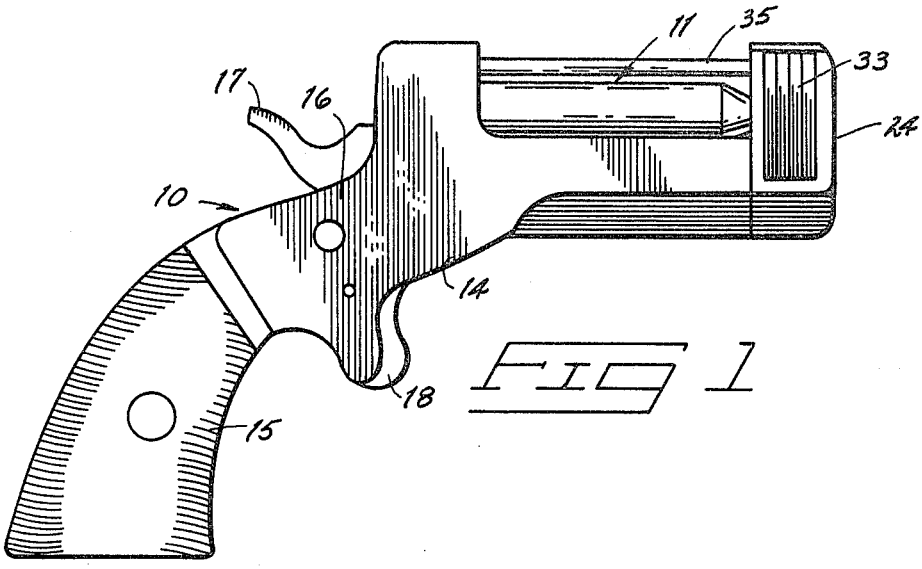
FIG. 1 is a side elevation view of the present pistol and insert.

The present invention is embodied in a pistol that is generally shown at 10 in the drawings, and a cartridge shaped barrel insert 11. The pistol body receives the insert 11 for the purpose of firing standard rim fire cartridges 12. The insert can be used with the pistol 10, or it can also be used in a center-fire weapon, replacing the usual center fire cartridge (not shown).

Figure 4:
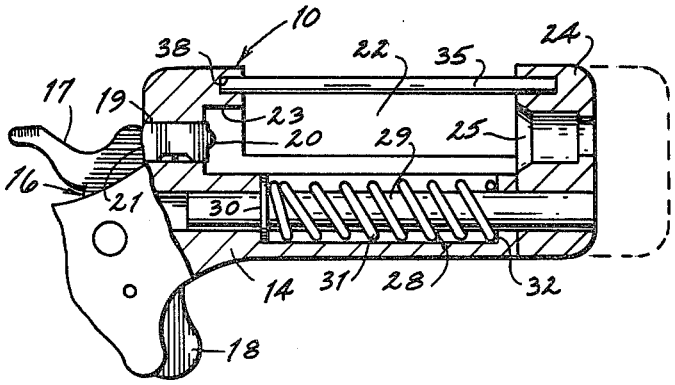
FIG. 4 is a fragmentary view of the present pistol body.

The present pistol 10 may be provided in two basic configurations. It may be provided with the cartridge shaped barrel insert 11 as shown in FIG. 1, or without the insert as shown in FIG. 4 wherein the basic pistol body is illustrated.

The pistol body is comprised of a general rigid frame 14, having a handgrip or handle 15. The frame 14 also defines a hammer and trigger housing 16. A hammer mechanism 17 is mounted to the frame and spring loaded within the housing 16. A trigger mechanism 18 is also provided within the housing and is mechanically interconnected with the hammer mechanism 17 by an appropriate form of well known trigger and hammer release mechanism (not shown).

The hammer mechanism 17 is used to strike a primary firing pin 19. The firing pin 19 is slidably mounted within the frame 14, having a striking surface 21 at one end and a projection 20 at the opposite end. The projection 20 is shaped similarly to a standard center fire firing pin. The firing pin and projection are centered on a bore axis of the insert 11 within a breech recess 23 in the frame 14.

Figure 5:
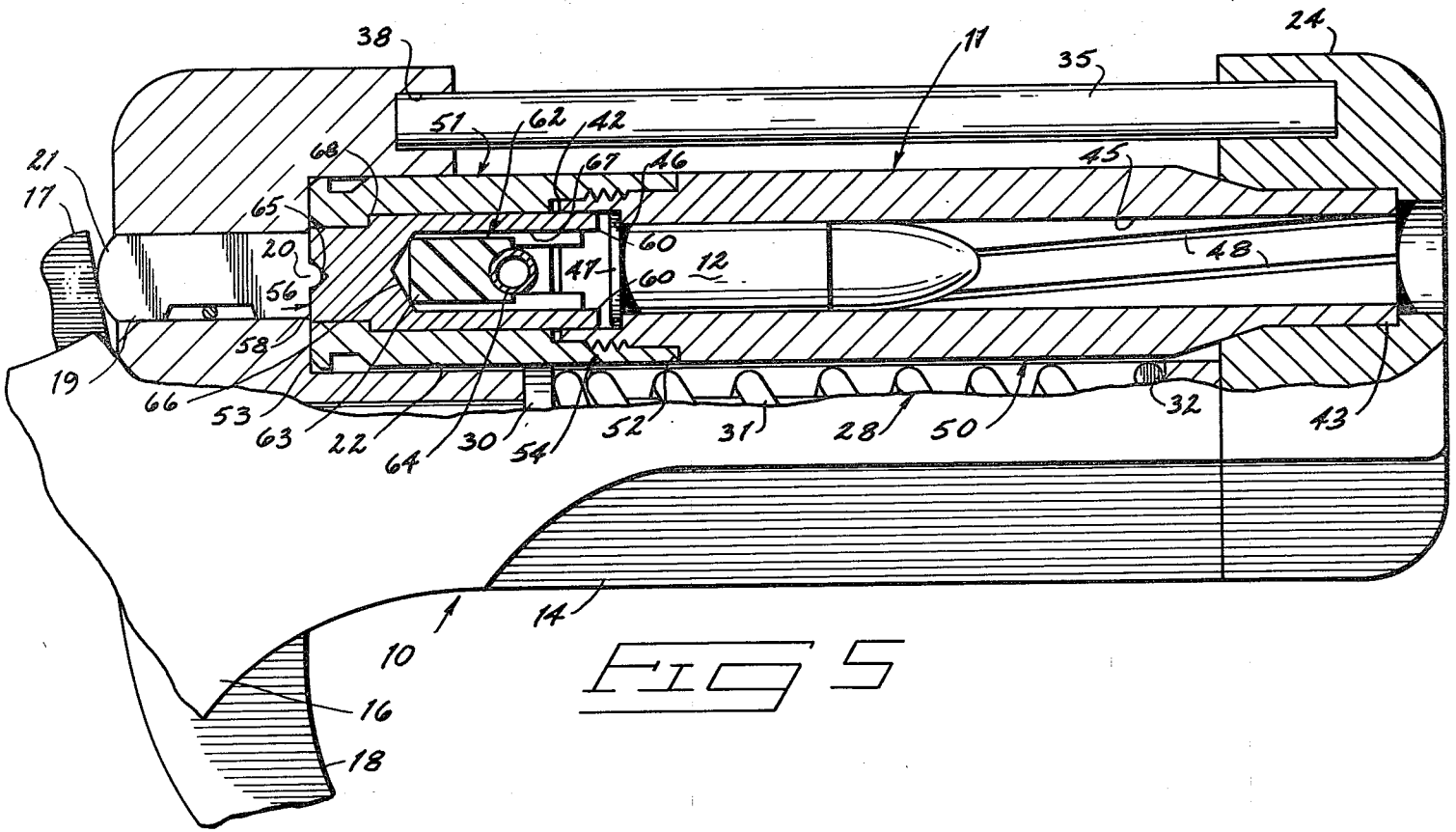
FIG. 5 is an enlarged fragmentary view of the present pistol and insert assembly.

Forward of the primary firing pin 19 and recess 23 is a long depression 22 (FIG. 4) along the frame that is adapted to receive the cartridge shaped barrel insert 11. The firing pin 19 and breach recess 23 are at one end of the depression 22. The opposite end of the depression 22 is defined by a muzzle nose piece 24. The muzzle nose piece 24 is mounted to the frame 14 for selective axial movement thereon. It includes a muzzle end recess 25 to releasably receive a forward end of the barrel insert 11. The recesses 23 and 25 are axially aligned when the insert is in place as shown in FIG. 5.

Figure 3:
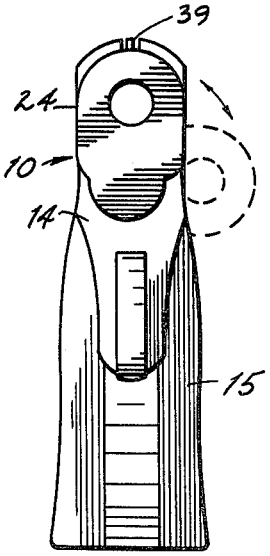
FIG. 3 is an end view of the pistol as seen from the right in FIG. 1.

A biasing means 28 is illustrated in FIG. 4 for continuously urging the nose piece 24 inwardly, toward the primary firing pin 19. The biasing means 28 operates along a rod 29 that is affixed to the nose piece 24 and slidably journalled in the frame 14. The rod 29 is held by the frame 14 along an axis that is parallel to the bore axis of the insert. A shoulder 30 at a remote end of the rod mounts one end of a compression spring 31. The opposite end of the compression spring rests against an integral shoulder 32 formed within the frame. The spring 31 therefore resists axial motion of the nose piece toward the dotted line position as shown in FIG. 4. The spring and rod both allow for turning motion of the nose piece about the axis of the rod as indicated by the dashed line position shown in FIG. 3.

The muzzle nose piece 24 is allowed to move axially to the FIG. 4 dashed line position in order to allow insertion and removal of the cartridge barrel insert 11. Pivotal motion of the nose piece is also permitted to facilitate insertion and removal of the barrel insert, as will be discussed in greater detail below. The nose piece 24 has serrations 33 on opposite sides thereof to facilitate gripping between the thumb and forefinger so the nose piece can be pulled outwardly and turned about the axis of the rod 29.

Figure 2:
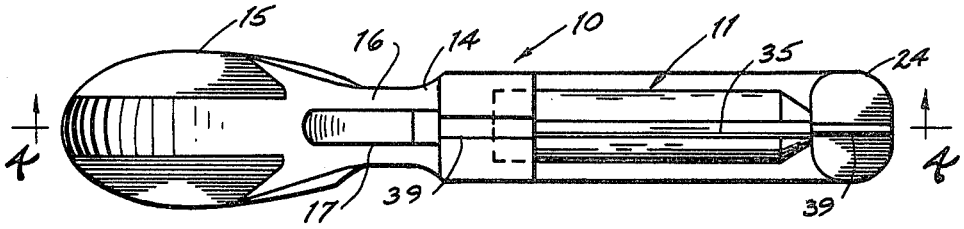
FIG. 2 is a top plan view as seen from above in FIG. 1.

A sight rod 35 is mounted between the nose piece 24 and frame 14. Preferably, the sight rod 35 is affixed to the nose piece 24 and is releasably received within a recess 38 of the frame 14. It is preferred that the sight rod 35 be situated over the recess 22 in order to present a straight axial reference for sighting purposes and to brace the muzzle nose piece 24 in its operative position. The sight rod 35, when used in sighting or aiming the pistol, will be used in combination with integral sights 39 (FIGS. 2 and 3) situated in the frame 14 and nose piece 24.

Figures 6, 7:
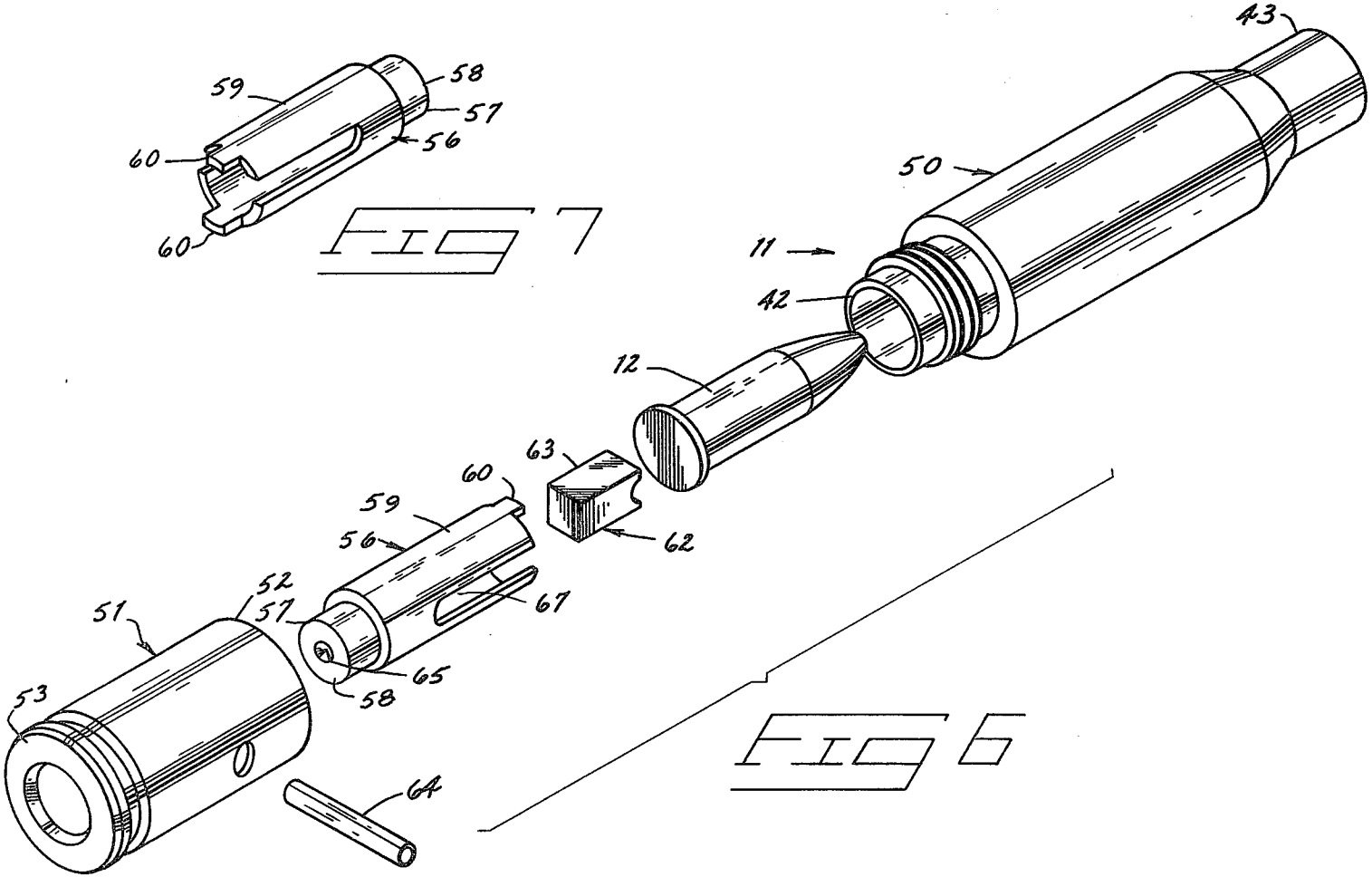
FIG. 6 is an exploded pictorial view of the present insert assembly.
FIG. 7 is a pictorial detail view of a secondary firing pin for the present insert.

The cartridge shaped barrel insert 11 is shown in substantial detail in FIGS. 5 through 7. Generally, the insert 11 is shaped similarly to the external configuration of a center-fire cartridge. However, the insert includes mechanisms that allow a smaller bore rimfire cartridge 12 to be fired from it. The insert is preferably constructed of steel commonly used for barrel construction in rifles and pistols.

The insert includes basically two independent sections. The barrel section 50 is provided to receive a cartridge 12. The barrel section 50 extends between a breach end 42 and a muzzle end 43. A central bore 45 extends between the ends 42 and 43. A shoulder 46 is formed within the breech end 42 of the barrel section to abut the corresponding rim 47 of a rimfire cartridge 12. This relationship is best illustrated in FIG. 5.

The bore 45 includes standard rifling 48 along its length. The rifling 48 is provided to guide and spin the bullet when it is fired, since the barrel of a larger bore weapon cannot be used for this purpose.

A breech block section 51 is releasably attached to the barrel section 50 at the breech end 42. The breech block 51 includes mechanisms for firing the enclosed cartridge 12 and can be actuated by the primary firing pin 19 of the pistol, or a standard center-fire firing pin of an appropriate large bore weapon (not shown).

The breech block 51 extends from a forward end 52 to a back end 53. The forward end 52 includes means 54, preferably threads, for releasably attaching the breech block to the barrel section. The mating threads between the breech block 51 and barrel section 50 are positioned so the forward end of the breech block 51 overlaps the shoulder 46 of the bore 45. This allows easy access to the cartridge 12 both for loading and unloading purposes.

A secondary firing pin is provided at 56 within the breech block 51. The back end 57 of the secondary firing pin appears very similar to the primer cap of an ordinary center-fire cartridge, presenting a striking surface 58. The body 59 of the firing pin extends forwardly from the striking surface 58 to a pair of pin projections 60 at a pin front end 61. The pin projections 60 are diametrically opposed in relation to the central bore axis. They are also spaced apart to simultaneously engage the circular rim of a rimfire cartridge held within the bore 45. Because there are two pin projections 60, it is logical that it will require approximately twice the impact produced through the firing pin in order to compress the rim 47 sufficiently to ignite the enclosed primer material. The dual projections 60 also assure firing of the small bore cartridge since two areas of the rim are struck instead of the usual one.

A resilient means 62 is provided within the breech block 51 in order to yieldably resist motion of the secondary firing pin toward the rim of the cartridge 12. Thus, the pin projections 60 are normally urged axially away from the cartridge rim 47. This is an extremely important safety feature for the present invention.

The resilient means 62 may be provided in the form of a resilient pad 63 situated within a bore 67 in the body of the pin 56. The pad 63 is loosely mounted between a roll pin 64 and a closed end 66 of the bore 67 in which it is received. A compression spring may be substituted for the pad 63 but it has been found that a synthetic material, such as a resilient urethane, may be used. The roll pin 64 prevents the secondary firing pins 60 and pad 63 from dropping out of the breech block 51 through the forward end thereof.

Interfitting shoulders 68 between the pin and breech block 51 prevent the pin from sliding rearwardly from the breech block. The pad 63 and pin 64 control the forward motion of the pin toward the center-fire cartridge rim 47. The yieldable resistance offered by the pad 63 is preselected to accommodate the relatively high spring forces applied through the firing pins of center fire weapons. Center fire "primer caps" require a stronger firing pin impact than do typical rimfire cartridges. The pad 63 absorbs a part of the additional impact energy of the weapon firing pin while transmitting just enough of such force through the secondary firing pin projection 60 to impact and fire the cartridge 12. The pad 63 therefore reduces the high impact force of the weapon firing pin to the reduced force required for firing a rimfire cartridge with the pin projections 60. Thus, a loaded insert 11 could not be easily fired accidently.

Normally, the firing pins of the various center fire weapons strike the soft brass caps of center fire ammunition and the sharpness or bluntness, (within broad limits) is not critical. The shape, hardness, and material of firing pins are therefore not standardized with firearms manufacturers. This non-standardness becomes a serious problem when using inserts with firing pins made of harder material than soft brass as the hard brittle firing pin point will readily break unless protected. A conical recess 65 on the striking surface 58 of my firing pin allows it to receive the various size and shaped large bore firing pins and assures that there is 360° contact regardless of the shape. None of the prior state of the art address to this problem. Using a soft metal for the firing pin is not the answer as the metal will deform outwardly and freeze in its housing. This is a common cause of failure of present inserts.

The conical recess 65 is centered on the striking surface. It is designed to receive the rounded shoulder of a standard large bore firing pin (not shown) or the projection 20 of the primary firing pin 19 for the pistol 10. The conical recess 65 is provided to substantially center the axial forces imported by a firing pin or by the primary pistol firing pin 19 and to evenly distribute the impact forces between the projection 20 (or large bore firing pin) and the secondary firing pin. The inclined surfaces of the recess 65 will engage a considerable surface area of the projection (or firing pin) thereby evenly distributing the axial force to the secondary firing pin. The secondary firing pin can therefore be constructed of relatively rigid materials that could otherwise damage or break standard firing pin ends.

The insert is loaded by unscrewing the breech block 51 from the barrel section. A rimfire cartridge is then inserted into the bore 45 with the rim 47 engaging the shoulder 46 (FIG. 5). The breech block 51 is then screwed back onto the barrel section. It is noted that the threads and the overlapping arrangement of the breech block and barrel section serve to strengthen the entire insert unit. The threads also serve to gauge the effective distance between the firing pin projections 60 and the cartridge rim 47. It is also noted that the resilient means 62 holds the firing pin in a retracted position at all times so the cartridge rim is not touched by the firing pin projections until sufficient force is applied either through the pistol firing pin 19 or the firing pin of an appropriate large bore weapon.

The resilient means 62 will also absorb some of the large bore rifle's firing pin spring pressure upon firing, which is greater than the average rimfire pistol. The purpose of the dual firing pin projections 60 is also to further absorb some of the large bore firing pin spring pressure to make it more near that of the standard rimfire weapon and to doubly insure that the rimfire cartridge fires.

It sometimes occurs that in manufacture of rimfire cartridges that the "paste powder" which is meant to fully fill the inside circumference of the shell rim does not occur. Therefore, when the small single point firing pin strikes that void area, the result is a "misfire". This is not uncommon in rimfire ammunition. The dual projections of the present firing pin, however, will nearly completely eliminate misfiring.

The loaded insert 11, if it is to be fired from a large bore weapon, can be carried with other inserts in a pocket or pack until such time that it is needed. An example is when a hunter encounters small game that he or she may wish to take with a small caliber bullet or bird shot. A "flare load" could also be carried in the insert in case of emergencies.

The present insert may be easily made to be distinguishable from ordinary brass cartridges. The first distinguishing characteristic, of course, is that it does not have a bullet projecting from the breech end. The present insert is also preferably constructed of "blued" steel that is easily distinguishable from the bright brass color of ordinary cartridges.

The insert is loaded into the barrel of a large bore weapon in the same manner as an ordinary cartridge is loaded into the barrel. The weapon is aimed and fired in the same manner as it is usually aimed and fired. However, the firing pin will strike the secondary firing pin 56 within the conical recess 65, moving it forwardly against resistance of the resilient means 62 to move the firing pin projections 60 into engagement with the cartridge rim 47. The force of engagement between the projections 60 and the cartridge rim 47 is sufficient to ignite the "primer" within the rim and the adjacent powder within the cartridge case. The expanding gases force the bullet from the cartridge end and through the bore 45 where the rifling 48 guides the bullet and causes it to spin on its axis. The bullet will leave the muzzle end of the insert and will move through the barrel of the large bore weapon without touching the walls of the bore thereof. The bullet will take the same path (through a shorter range) that the standard large bore center fire bullet would if fired from the same weapon.

When the insert has been fired, it is removed from the large bore weapon in the same manner that an ordinary cartridge would be removed. The breech block 51 is then removed and the spent casing of the rimfire cartridge can be removed from the barrel section. This is done either by using a short length of rod similar to the sight rod 35 for the pistol, or by simply using an available twig or branch of sufficient diameter and length. The rod or twig is inserted through the muzzle end 43 along the bore to engage the closed end of the cartridge and push it outwardly beyond the shoulder 46 where it can be pulled free of the barrel section. The barrel can then be reloaded and reattached to the breech block for further use.

The insert 11 is also as easily utilized by the present pistol body.

To load the insert into the pistol body, the muzzle nose piece 24 is first gripped and pulled outwardly to disengage the sight rod 35 from the frame recess. The nose piece is also rotated approximately 90° about the axis of the rod 29 to the position shown by dashed lines in FIG. 3. This moves the sight rod 35 clear of the depression 22. It is noted that when the nose piece is pulled out, the compression spring 31 is placed under higher compression than when it is released.

The insert may then be placed in the depression 22 with the breech block back end 53 being received within the breech recess 23 and adjacent the primary firing pin 19. The nose piece 24 is then gripped again and pulled outwardly to move the inner facing surface of the nose piece outwardly clear of the muzzle end 43 of the insert. The nose piece is then rotated back to the operative position and released so the muzzle end 43 is received in the nose piece recess 25 and so the sight rod 35 is received in its complementary recess 38 along the frame. The pistol is then loaded and ready to fire.

Firing the pistol involves the simple process of cocking the hammer 17, aiming the pistol by using the appropriate sights 39 and sight rod 35, and firing by pulling the trigger 18. When the trigger is pulled, the hammer strikes the primary firing pin 19, driving it forward against the secondary firing pin 56 of the insert. The firing pin projection 20 will fit within the conical recess 65 of the secondary firing pin.

The forward force of the primary firing pin causes axial forward movement of the secondary firing pin 56, against the resistance of the resilient means 62. This resistance is overcome by the force in the forward direction, and the firing pin proceeds on forwardly to bring the two pin projections 60 forceably into contact with the rim 47 of the cartridge. The cartridge then fires and the bullet leaves the insert through the muzzle end 43 of the barrel section.

Unloading the pistol is accomplished by pulling the muzzle nose piece 24 outwardly until the sight rod end clears the frame and the nose piece recess moves clear of the insert muzzle end 43. The nose piece is then rotated to one side and released. The insert can then be removed from the frame recess and disassembled to allow access to the spent cartridge casing.

The sight rod 35 is used in this situation to drive the spent casing outwardly of the barrel section. This is done simply by inserting the now exposed sight rod end into the muzzle end of the bore 45 and moving it rearwardly to engage and push the spent cartridge casing from the barrel section. After this is done, a fresh cartridge can be inserted into the bore 45 and the breech block 51 threaded onto the barrel section. The now loaded insert can then be repositioned in the pistol for subsequent firing.

For convenience of having various loads ready to fire, several of the loaded inserts 11 may be carried.

It is noted that with a simple shim (not shown), a single pistol body can be made to accommodate barrel inserts 11 that are adapted to be received in different large bore weapons. For example, such a shim could be made to accommodate cartridge shaped inserts of a standard 30-06 or 0.270 caliber rifle cartridges. The "shim" would be held in place in the nose piece by a simple set screw (also not shown). The shim would give the 0.270 and, say, the 25.06, the same overall length and shoulder/neck measurements as the 30.06 cartridge case.

It is also pointed out that the nose piece and pistol frame can be quite easily designed to accommodate more than a single cartridge shaped barrel insert 11. In fact, it is contemplated that two or more inserts may be provided that could simply be shifted into alignment with the firing pin 19 by simply pulling the nose piece outwardly and rotating it to bring the successive insert into firing position.

Other changes and modifications may become apparent that fall within the scope of the present claims.

I claim:

1. A pistol body for releasably receiving a cartridge barrel in the form of a large bore cartridge, comprising:

a frame having a handle with a trigger and hammer housing at one end;

said frame having a muzzle nose piece at a remaining frame end;

a laterally open barrel receiving depression formed in the frame between the trigger and hammer housing, and the muzzle nose piece, adapted to receive the cartridge barrel;

a firing pin mounted within the frame adjacent the barrel depression, said firing pin being movable within the frame along a central axis;

a hammer and trigger mechanism within the housing on the frame, a trigger being selectively operable to actuate a hammer to strike the firing pin and move it axially toward the barrel receiving depression;

wherein the muzzle nose piece is spaced axially forward of the firing pin, and is axially movable on the frame to receive and secure a cartridge barrel within the barrel receiving depression; and biasing means operatively connecting the muzzle nose piece and the frame for yieldably urging the nose piece axially toward the firing pin to yieldably press a cartridge barrel against the trigger and hammer housing with the cartridge barrel centered axially on the central axis of the firing pin.

2. The pistol body as claimed by claim 1 further comprising a sight rod between the nose piece and housing, extending parallel to the central axis over the barrel receiving depression, clear of a cartridge barrel received therein for aligning the nose piece with the firing pin with the cartridge barrel coaxial with the central axis.

3. The pistol body as claimed by claim 1 wherein the nose piece is rotatable on the frame about a pivot axis parallel to the central axis.

4. A pistol, comprising:

a frame having a handle at one end and an adjacent hammer and trigger housing;

a muzzle nose piece at a remaining frame end;

a laterally open barrel receiving depression formed in the frame between the hammer and trigger housing and the muzzle nose piece;

a primary firing pin mounted to the frame for axial movement along a central axis adjacent the depression;

a hammer and trigger mechanism within the the housing, with a trigger being selectively operable to actuate a movable hammer to strike the firing pin and move it axially toward the depression;

a barrel having a breech end and a muzzle end, with an open bore extending between said breech and muzzle ends;

said barrel being releasably received within the depression with the breech end axially aligned with the firing pin, said breech being adapted to receive a cartridge;

wherein the muzzle nose piece is mounted to the frame and is spaced axially from the firing pin and axially movable on the frame to selectively engage and yieldably secure the muzzle end of the barrel axially to the frame with the muzzle bore coaxial with the central axis; and biasing means operatively connecting the muzzle nose piece and the frame for yieldably urging the nose piece axially toward the firing pin to yieldably urge the barrel axially against the hammer and trigger housing.

5. The pistol as claimed in claim 4 wherein the muzzle nose piece is pivotal about an axis parallel to the central axis and axially movable along the pivot axis toward and away from the firing pin.

6. The pistol as claimed by claim 4 further comprising:

an elongated sight rod mounted between the frame and nose piece extending over the depression in parallel relation to the central axis.

7. The pistol as claimed by claim 6 wherein the sight rod is fixed to the nose piece and is adapted to be received axially within the barrel bore to dislodge spent cartridges from the breech end thereof.

8. The pistol as claimed by claim 4 wherein the primary firing pin is coaxial with the central axis and wherein the barrel includes a secondary firing pin assembly removably mounted thereto at the breech end, and operable in response to axial motion of the primary firing pin, to move axially toward the barrel breech end and to engage and fire a cartridge held therein.

9. The pistol as claimed by claim 8 for firing rimfire cartridges and wherein the secondary firing pin assembly includes:

a breech block having a forward end adapted to be releasably secured to the breech end of the barrel;

a secondary firing pin body having a front end and a back end mounted within the breech block for axial slidable motion therein toward and away from the rim of a cartridge held in the barrel breech;

a striker surface at the back end of the secondary firing pin body for being struck by the primary firing pin;

two pin projections at the front end of the secondary firing pin body for striking the rim of a rimfire cartridge held in the breech end of the barrel breech at two spaced positions thereon.

10. The pistol as claimed by claim 9 further comprising resilient means within the breech block engaging the secondary firing pin body to yieldably urge the secondary firing pin body away from a cartridge held in the breech end of the barrel.

11. The pistol as claimed by claim 9 wherein the primary firing pin includes a pin projection centered on the central axis; and wherein the striker surface of the secondary firing pin body includes a conical recess for receiving the pin projection of the primary firing pin.

* * * * *